US011662160B2

(12) United States Patent
Dolderer et al.

(10) Patent No.: US 11,662,160 B2
(45) Date of Patent: May 30, 2023

(54) COLLECTOR TUBE FOR A HEAT EXCHANGER

(71) Applicant: Mahle International GmbH, Stuttgart (DE)

(72) Inventors: Axel Dolderer, Grossbottwar (DE); Uwe Foerster, Erdmannhausen (DE); Martin Kaspar, Fellbach (DE)

(73) Assignee: Mahle International GmbH

( * ) Notice: Subject to any disclaimer, the term of this patent is extended or adjusted under 35 U.S.C. 154(b) by 215 days.

(21) Appl. No.: 16/692,912

(22) Filed: Nov. 22, 2019

(65) Prior Publication Data

US 2020/0166294 A1 May 28, 2020

(30) Foreign Application Priority Data

Nov. 23, 2018 (DE) ..... 10 2018 220 143.9

(51) Int. Cl.
*F28F 9/02* (2006.01)

(52) U.S. Cl.
CPC ..... *F28F 9/0202* (2013.01); *F28F 9/0224* (2013.01)

(58) Field of Classification Search
CPC ... F28F 9/0212; F28F 9/0224; F28D 1/05375; F28D 1/05391
See application file for complete search history.

(56) References Cited

U.S. PATENT DOCUMENTS

| | | | |
|---|---|---|---|
| 5,107,926 | A | 4/1992 | Calleson |
| 6,145,589 | A | 11/2000 | Gowan |
| 6,289,980 | B1 | 9/2001 | Insalaco et al. |
| 9,097,469 | B2 | 8/2015 | Foerster et al. |
| 9,523,540 | B2 | 12/2016 | Hirayama et al. |
| 9,546,828 | B2 | 1/2017 | Moreau et al. |
| 2007/0074860 | A1 | 4/2007 | Shinhama |
| 2016/0356532 | A1 | 12/2016 | Wijaya et al. |

FOREIGN PATENT DOCUMENTS

| | | | |
|---|---|---|---|
| CN | 203811013 | U | 9/2014 |
| CN | 104422331 | A | 3/2015 |
| CN | 206626857 | U | 11/2017 |

(Continued)

OTHER PUBLICATIONS

Chinese Search Report dated Aug. 8, 2022 for copending Chinese App No. 201911154851.0 (with English translation).

(Continued)

*Primary Examiner* — Eric S Ruppert
(74) *Attorney, Agent, or Firm* — Fishman Stewart PLLC

(57) ABSTRACT

A collector tube for a heat exchanger, which may have at least one flat tube, may include at least one recess, through which a separator may be inserted into the collector tube in an insertion position. The separator may have a separating wall comprising a separating wall thickness, wherein a clearance fit may be present between the separating wall and the recess in response to the insertion of the separator. The separating wall may provide at least one elevation to attain an increase of the separating wall thickness in a subarea of the separator. In the insertion position of the separator, the at least one elevation may be arranged in an area of the recess. In the insertion position, a press fit may be present between the at least one elevation and the recess.

20 Claims, 3 Drawing Sheets

(56) References Cited

FOREIGN PATENT DOCUMENTS

| | | | | | |
|---|---|---|---|---|---|
| CN | 206627006 | U | | 11/2017 | |
| DE | 41 30 517 | A1 | | 3/1993 | |
| DE | 4130517 | A1 | * | 3/1993 | ..... F28F 9/0212 |
| DE | 10343634 | A1 | * | 4/2005 | ..... F28D 1/0535 |
| DE | 10 2007 016 050 | A1 | | 10/2007 | |
| DE | 10 2006 053 702 | A1 | | 5/2008 | |
| DE | 10 2009 023 954 | A1 | | 12/2010 | |
| DE | 10 2013 205 763 | A1 | | 10/2013 | |
| EP | 1 347 259 | A1 | | 9/2003 | |
| EP | 2 097 707 | A1 | | 9/2009 | |
| EP | 2 648 862 | A1 | | 10/2013 | |
| FR | 2 952 711 | A1 | | 5/2011 | |
| JP | H0552578 | U | | 7/1993 | |
| JP | H0552578 | U | * | 7/1993 | ..... G11B 15/4738 |
| JP | H0596789 | U | * | 12/1993 | |
| JP | H0640684 | U | * | 5/1994 | |
| JP | 08334292 | A | * | 12/1996 | ..... F28F 9/0212 |
| JP | H08-334 292 | A | | 12/1996 | |
| JP | 2004-211 925 | A | | 7/2004 | |
| KR | 20070051506 | A | * | 5/2007 | |
| WO | 2014/131 756 | A1 | | 9/2014 | |
| WO | 2015/079 653 | A1 | | 6/2015 | |
| WO | 2015/086 195 | A1 | | 6/2015 | |

OTHER PUBLICATIONS

Chinese Office Action dated Aug. 12, 2022 for copending Chinese App. No. 201911154851.0 (with English translation).
English abstract for JP-H08-334 292, Dec. 17, 1996.
English abstract for DE-10 2007 016 050, Oct. 31, 2007.
English abstract for DE-10 2006 053 702, May 15, 2008.
English abstract for JP-2004-211 925, Jul. 29, 2004.
English abstract for FR-2 952 711, May 10, 2011.
English abstract for DE-41 30 517, Mar. 18, 1993.

* cited by examiner

COLLECTOR TUBE FOR A HEAT EXCHANGER

CROSS-REFERENCE TO RELATED APPLICATIONS

This application claims priority to German Patent Application No. DE 10 2018 220 143.9, filed on Nov. 23, 2018, the contents of which are hereby incorporated by reference in their entirety.

TECHNICAL FIELD

The present invention relates to a heat exchanger for a vehicle as well as to a collector tube for such a heat exchanger.

BACKGROUND

In vehicles, heat exchangers and in particular condensers are used, for example, as part of an air conditioning circuit for regulating the room temperature in the vehicle interior. The heat exchanger or condenser, respectively, has a plurality of flat tubes, which are spaced apart from one another and which are fluidically connected to one another by means of at least one collector tube. A gaseous refrigerant, which was compressed by a compressor of the air conditioning circuit, initially flows into the collector tube through an inlet and subsequently through the flat tubes. While the refrigerant flows through the flat tubes, it dissipates its heat energy to the flat tubes or to the surrounding area of the flat tubes, respectively, so that it cools down and condenses. The condensed or liquid refrigerant, respectively, is supplied to the air conditioning circuit again via an outlet.

To specify a flow path of the refrigerant inside the heat exchanger or of the condenser, respectively, at least one separating element is arranged inside the collector tube, so that the collector tube is divided into at least two fluidically separate subareas. In the known prior art, the fixation of such a separating element inside the tube prior to a soldering process is problematic, because a tilting and/or displacing of the separating element can lead to a lack of tightness and/or to an unwanted flow path, so that the desired heat transfer cannot take place in an optimal manner.

SUMMARY

The present invention is based on the object of specifying a collector tube of the above-mentioned type, in which at least one separating element can be positioned so as to be protected against tilting and/or displacing.

The present invention is based on the general idea that the collector tube has at least one recess, through which a separating element can be inserted into the collector tube.

The collector tube according to the invention for a heat exchanger, which has at least one flat tube, comprises a recess, through which a separating element is inserted into the collector tube in an insertion position. The insertion position can be characterized in that a boundary contour of the separating element abuts against an inner wall of the collector tube in such a way that a first subarea of the collector tube and a second subarea of the collector tube are fluidically separated from one another by means of the separating element. Tolerances in the inner wall of the collector tube thus have no impact on the tightness of the separating wall, because the separating wall can, for example, be inserted deeply or less deeply into the collector tube, according to the available inner wall, in order to balance the production tolerances of the inner wall. The recess of the collector tube can have an essentially rectangular embodiment.

The separating element has a separating wall comprising a separating wall thickness, wherein a clearance fit is present between the separating wall and the recess in response to the insertion of the separating element. A clearance fit can be present, when the separating wall inside the recess has a certain freedom of movement, so that the separating wall can be moved freely against the recess. This can also be understood such that the subarea of the separating element, which embodies the separating wall, can be inserted into the collector tube, without the separating wall touching an edge area of the recess.

The separating wall further provides at least one elevation, in order to attain an increase of the separating wall thickness in a subarea of the separating element. Such an elevation can be embodied, for example, integrally by the separating wall and/or by the separating element, wherein it is also conceivable that the elevation can be attached to the separating wall and/or the separating element via a releasable connection or a non-releasable connection.

It is provided that, in the insertion position of the separating element, the at least one elevation is arranged in the area of the recess, wherein, in the insertion position of the separating element, a press fit is present between the elevation and the recess. A press fit can be present, when the separating element at least partially experiences an elastic and/or plastic deformation in response to the insertion into the insertion position in the area of the elevation, so that the separating element cannot move freely with respect to the recess. It is thus prevented that the separating element falls out prior to and/or during a soldering process.

The separating element is used to segment the collector tube and, for example, to provide for a meander-shaped flow guidance of the refrigerant through the flat tubes. The shape of the separating wall is selected in such a way that a fluid-tight separation of two segments or subareas, respectively, of the collector tube is ensured. The collector tube can thereby be embodied in one piece or also in several pieces. The collector tube can embody a longitudinal duct comprising a cross section, which can be embodied, for example, so as to be essentially circular in some areas and/or essentially semi-circular in some areas.

In the case of an advantageous further development of the solution according to the invention, it is provided that the separating element has a ledge, which, in the insertion position of the separating element, is arranged outside of a longitudinal duct of the collector tube. This leads to an improved separation of the separating elements as loose material, wherein a mutual flat attachment is avoided. This can provide for a supply of the separating elements, in response to which separating elements, for example, are guided to the assembly location by a vibrating conveyor via a sliding rail. It can be provided that the ledge thereby hooks into a sliding rail.

In the case of a further advantageous embodiment of the solution according to the invention, it is provided that the separating element has at least two elevations, which are spaced apart from one another. It can be provided thereby that a first elevation is arranged on a first surface side of the separating element and a second elevation on a second surface side of the separating element. It is also conceivable, however, that a first elevation and a second elevation are arranged on one surface side of the separating element. The distance between the elevations can, for example, correspond to at least twice the dimension and/or diameter of the respective elevation. A first elevation and a second elevation can be embodied identically or can also be embodied differently.

In the case of an advantageous further development of the solution according to the invention, it is provided that at least one elevation has a circular embodiment. The elevation can be embodied, for example, cylindrically and/or in the shape of a truncated cone.

In the case of a further advantageous embodiment of the solution according to the invention, it is provided that the separating element at least partially has a curved boundary edge. This curved boundary edge can be embodied essentially complementary to the embodiment of the inner wall of the collector tube, in order to provide for an essentially positive insertion of the separating element.

In the case of an advantageous further development of the solution according to the invention, it is provided that the separating is embodied so as to be at least partially complementary to a subarea of an inner wall of the collector tube, in order to provide for an essentially positive insertion of the separating element.

In the case of a further advantageous embodiment of the solution according to the invention, it is provided that the collector tube is embodied of a base and a cover. The collector tube can be embodied in at least two parts, wherein the first component is the base and the second component is the cover. The base and the cover are arranged so as to be located opposite one another and can embody a longitudinal duct.

The base can have an outer base surface and an inner base surface. The outer base surface is defined as the surface of the base, which is in contact with the external environment in the case of the assembled collector tube. The remaining surface of the base, which is not in contact with the external environment in the case of the assembled collector tube, is defined as inner base surface.

The cover can have an outer cover surface and an inner cover surface. The outer cover surface is defined as the surface of the cover, which is in contact with the external environment in the case of the assembled collector tube. The remaining surface of the cover, which is not in contact with the external environment in the case of the assembled collector tube, is defined as inner cover surface.

The base and the cover can be assembled in such a way that the longitudinal duct is fluid-tight with respect to the external environment. For this purpose, the base can have at least one base collar. It can be provided that subareas of the inner base surface are in contact with subareas of the inner cover surface.

It can be provided that the base is embodied to be essentially flat. In this context, flat can be understood such that in the cross section of the longitudinal duct, the inner base surface has at least one curvature radius, which is larger than the smallest curvature radius of the inner cover surface.

In the case of an advantageous further development of the solution according to the invention, it is provided that the cover is arranged so as to be located opposite the base, wherein the base and the cover embody a longitudinal duct, wherein the base has at least one passage comprising an opening for accommodating a flat tube of the heat exchanger. The opening can have a cross section, which is adapted to the flat tube.

In the case of a further advantageous embodiment of the solution according to the invention, it is provided that the passage has a collar, which extends away from the longitudinal duct. The collar thus does not protrude into the longitudinal duct thereby. The collar can be torn from the inside to the outside. The respective flat tube can be inserted through the opening and the collar of the passage, wherein the front edge can be flush with the base area. The available space inside the heat exchanger or condenser, respectively, which has to be filled by the refrigerant, can be significantly reduced thereby. When using a comparatively expensive refrigerant, such as, for example, R1234yf, a reduction of the production or operating costs, respectively, of the heat exchanger can also be attained.

In the case of a further advantageous embodiment of the solution according to the invention, it is provided that at least one elevation along a first direction of extension and along a second direction of extension has identical dimensions and/or diameters.

In the case of an advantageous further development of the solution according to the invention, it is provided that at least one elevation along a first direction of extension and along a second direction of extension has different dimensions and/or diameters. It can be provided that the dimensions and/or diameters of the elevation along the second direction of extension are larger than the dimensions and/or diameters along the first direction of extension. The first direction of extension can be essentially parallel to an insertion direction of the separating element. The second direction of extension can be essentially transverse to an insertion direction of the separating element. The insertion direction is defined as the direction, along which the separating element is inserted into the collector tube in an insertion position.

In the case of a further advantageous embodiment of the solution according to the invention, it is provided that at least one elevation extends over the entire width of the separating wall along the second direction of extension.

In the case of an advantageous further development of the solution according to the invention, it is provided that at least one elevation can be larger in a diameter and can extend up to a curvature of the entire separating wall, and embodies a crown bow. This increases the elasticity when joining the separating wall, and reduces the required joining force of the separating wall, but simultaneously ensures a reliable abutment and tight soldering of the separating wall in the joint gap of the recess.

The invention further relates to a heat exchanger, in particular a condenser for a vehicle, which is equipped with a plurality of flat tubes, which are spaced apart from one another. The flat tubes are thereby fluidically connected to one another by means of at least one collector tube according to the invention, which is described above. For example two collector tubes or also only one collector tube can be provided, wherein in the case of one collector tube, the flat tubes can have a U-shaped course. It can also be provided that a collector tube has an inlet and an outlet, which can be connected to an air conditioning circuit of a vehicle. The flat tubes are introduced into openings of the collector tube, whereby it can be provided that front edges of the flat tubes are essentially flush with the base. If the base provides for a curvature, the front edges of the flat tubes can also have a curved course, so as to attain a flush closure with the base and so as to thus not reduce the flow cross section of the longitudinal duct.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the below description, whereby identical reference numerals refer to identical or similar or functionally identical components.

BRIEF DESCRIPTION OF THE DRAWINGS

In each case schematically.

DETAILED DESCRIPTION

Figure 1:
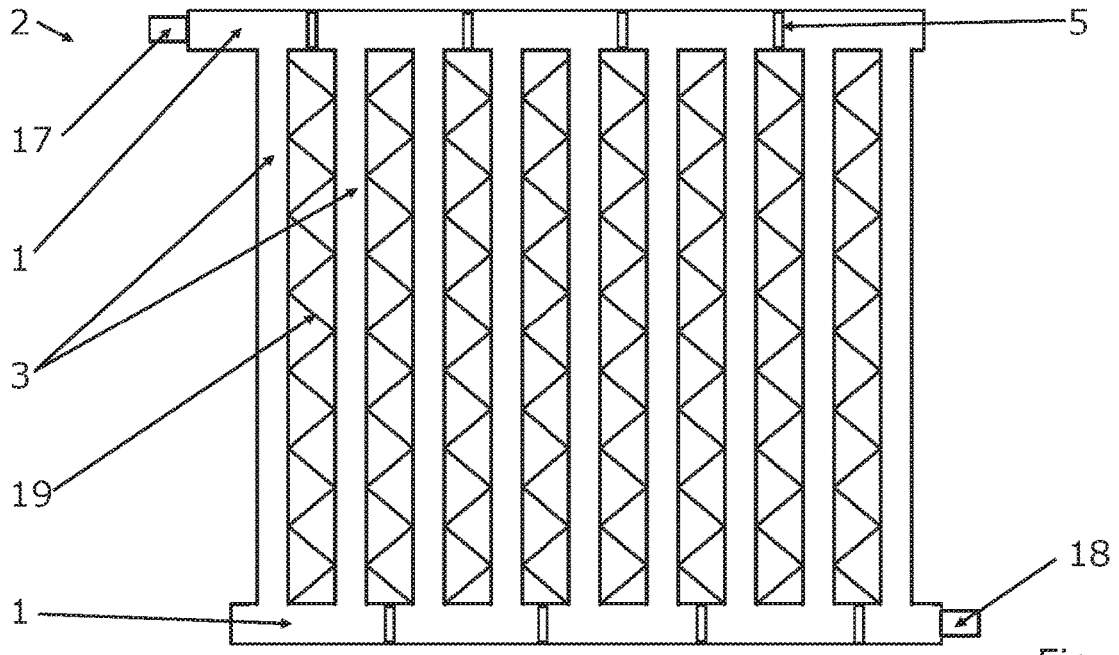
FIG. 1 shows a heat exchanger or condenser, respectively.

As illustrated in FIG. 1, the heat exchanger 2 has a plurality of flat tubes 3, which are fluidically connected to two collector tubes 1. The collector tubes 1 and the flat tubes 3 are arranged essentially transversely to one another. A first collector tube 1 is provided with an inlet 17, and a second collector tube 1 has an outlet 18. The inlet 17 and the outlet 18 can be connected to a non-illustrated air conditioning circuit of a vehicle, wherein the air conditioning circuit can be used to regulate the room temperature in the vehicle interior.

If the heat exchanger 2 is used as condenser, a refrigerant of the air conditioning circuit enters in the vaporous aggregate state into the collector tube 1 through the inlet 17 and flows through the flat tubes 3. Separating elements 5 are inserted in the collector tubes 1 in such a way that for example a meander-shaped flow guidance or flow path, respectively, of the refrigerant results. While the refrigerant flows through the flat tubes 3, it dissipates its heat energy to the flat tubes 3 or to the surrounding area of the flat tubes 3, respectively, so that it cools down and condenses. Fins 19, which increase the mechanical resistance of the heat exchanger 2 and which enlarge the surface, via which the heat energy of the refrigerant can be discharged to the external environment, are arranged between the flat tubes 3. The condensed refrigerant is supplied to the air conditioning circuit via the outlet 18.

Figure 2:
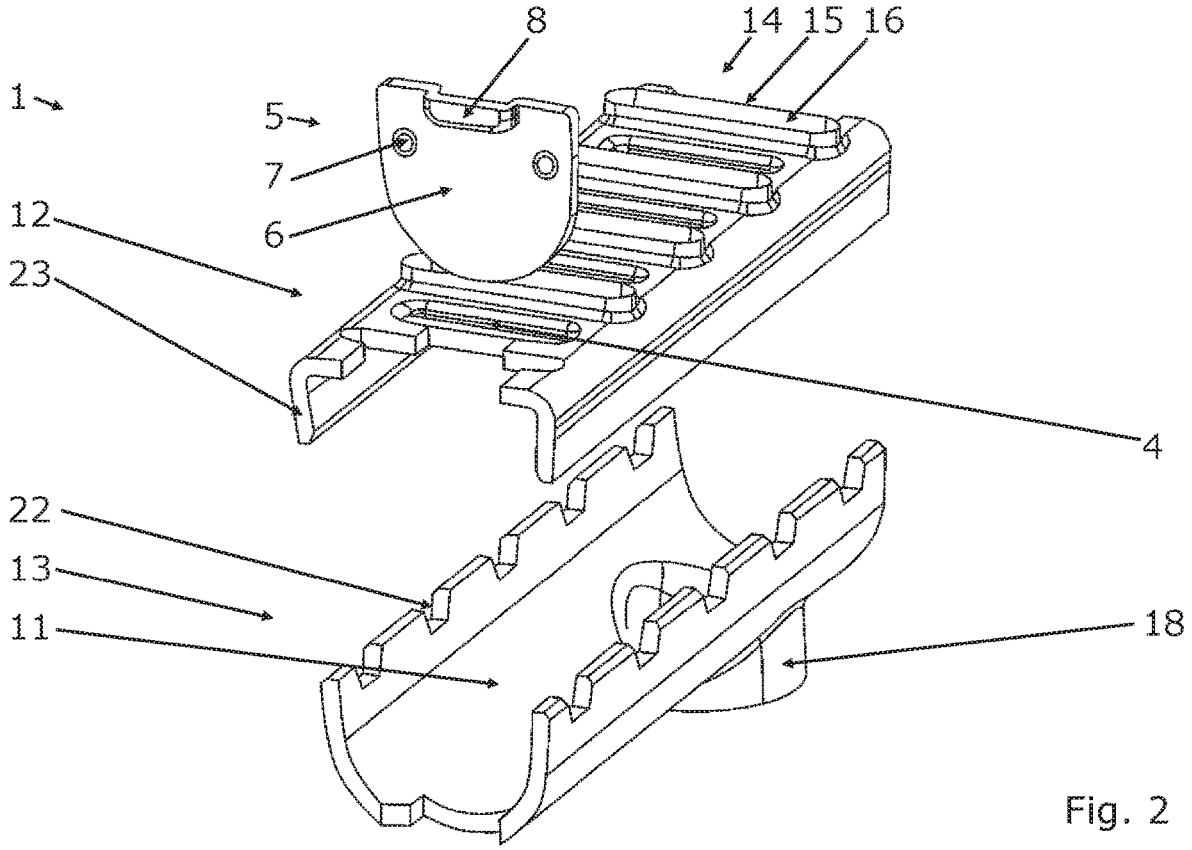
FIG. 2 shows a perspective view of a collector tube according to the invention prior to the assembly.
Figure 3:
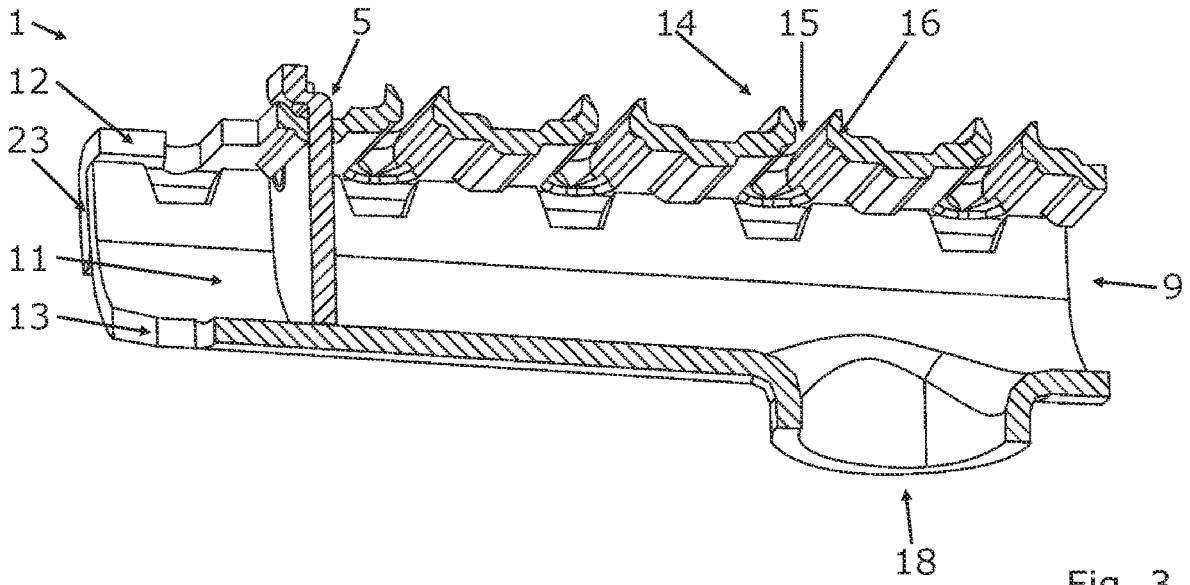
FIG. 3 shows a perspective longitudinal section of an assembled collector tube.

FIG. 2 shows a perspective view of a collector tube 1 according to the invention prior to the assembly. FIG. 3 shows a perspective longitudinal section of an assembled collector tube 1.

The collector tube 1 consists of a base 12 and a cover 13, wherein the base 12 has a base collar 23. Compared to the cover 13, the base 12 is embodied to be essentially flat. The base 12 and the cover 13 can be made of a sheet metal, wherein the collector tubes 1 as well as the entire heat exchanger 2 can be produced by means of soldering.

The base 12 and the cover 13 limit a longitudinal duct 9, through which a refrigerant can flow. In the assembled state of the collector tube 1, a subarea of the separating element 5 abuts against an inner wall 11 of the collector tube 1, in particular against an inner wall 11 of the cover 13.

The base 12 has a plurality of passages 14, which are arranged spaced apart from one another along the longitudinal extension of the longitudinal duct 9. Each passage 14 has an opening 15 and a collar 16, which extends away from the longitudinal duct 9. The opening 15 has a wide edge and a narrow edge, which correspond to the dimensions of the flat tubes 3 in such a way that the flat tubes 3 can be inserted through the respective opening 15. The opening 15 of the passage 14 can initially taper towards the longitudinal duct 9 and can subsequently widen again. The insertion of the respective flat tube 3 into the respective passage 14 can be simplified thereby.

In areas located opposite a passage 14, the cover 13 has recesses 22. These recesses 22 can be punched out of the areas, which are in contact with the base collar 23 after the assembly. These recesses 22 can be embodied to be trapezoidal.

The base 4 has recesses 12, into which the separating elements 13 can be inserted. The separating elements 13 can be inserted prior to or also after the assembly of the base 4 and of the cover 5. The separating element 13 is used to segment the collector tube 1 or the longitudinal duct 9, respectively, in order to attain a desired flow direction of the refrigerant through the heat exchanger 2.

Figure 4:
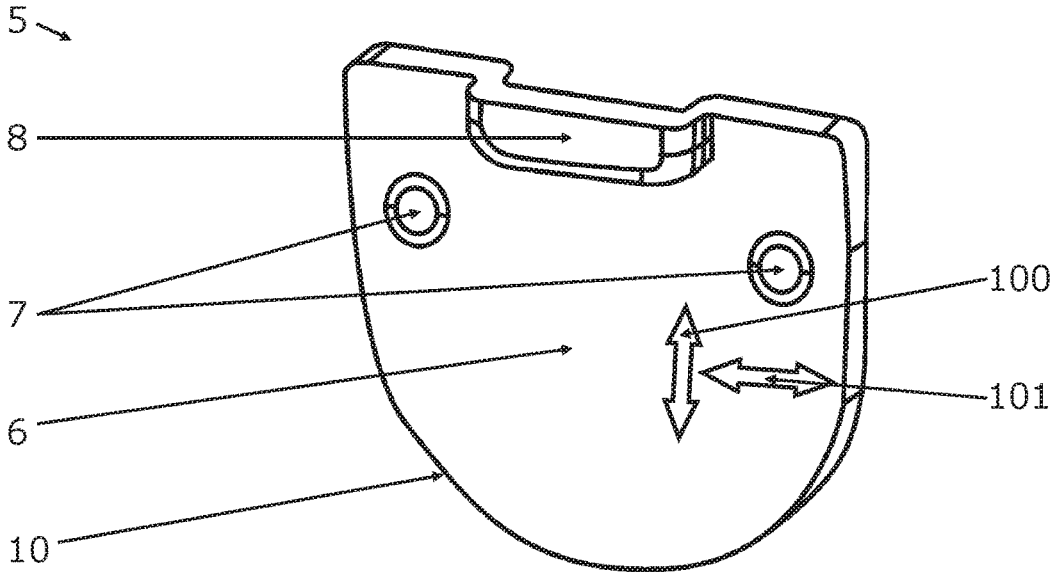
FIG. 4 shows a perspective view of a separating element.
Figure 5:
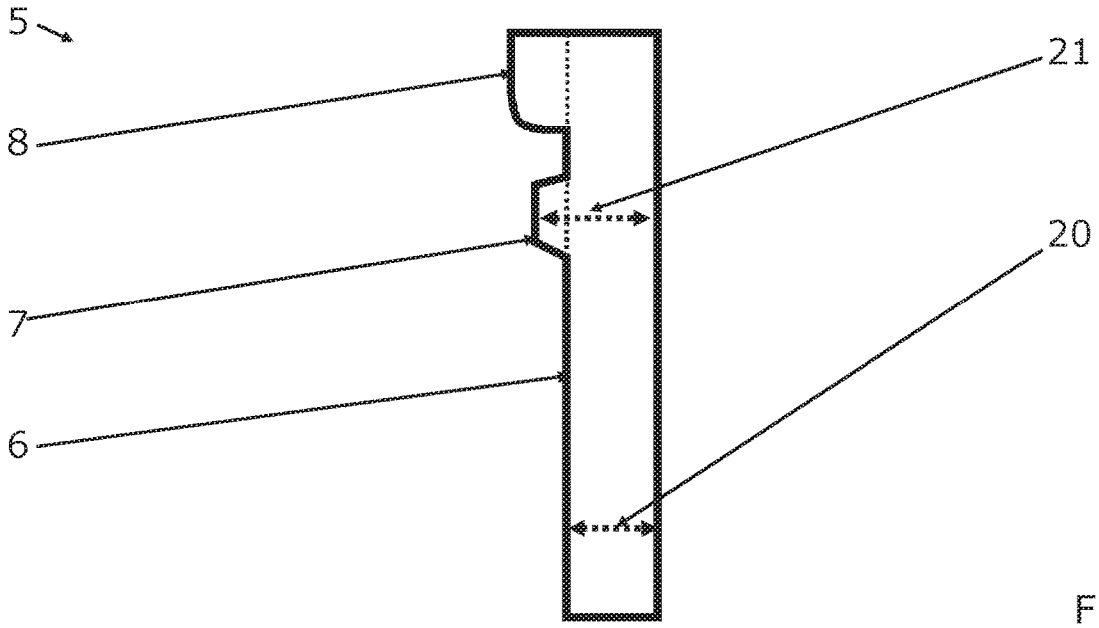
FIG. 5 shows a side view of the separating element of FIG. 4.

An enlarged perspective view of a separating element 5 is shown in FIG. 4, wherein a side view of the separating element 5 is illustrated in FIG. 5.

The separating element 5 has a separating wall 6 comprising a separating wall thickness 20 and at least one elevation 7. In FIG. 2, the separating element 5 is illustrated prior to the insertion into the base 12, and is shown in an insertion position in FIG. 3.

The separating wall 6 has a shape, which corresponds to the cross sectional contour of the longitudinal duct 9, so that the separating element 5, in its insertion position, provides for a fluid-tight segmenting or separation, respectively, of the collector tube 1 or of the longitudinal duct 9, respectively. For this purpose, the separating element 5 can have a curved boundary edge 10, which can be embodied so as to be at least partially complementary to a subarea of the inner wall 11 of the collector tube 1.

The elevation 7 leads to a local increase of the separating wall thickness, so that a separating wall thickness 21, which is larger than the separating wall thickness 20, is present in this area. The elevation 7 can be produced by means of additionally applied material or also, for example, by means of a forming process. The dimensions of the recess 4 are selected in such a way that the separating wall 6 can be pushed into the recess 4 without large resistance, wherein the dimensions of the elevation 7 are selected in such a way that, in the insertion position of the separating element 5, the elevation 7 is pressed into the recess 4. The separating element 5 has two elevations 7, which are spaced apart from one another and which have a circular and/or cylindrical and/or truncated cone-shaped embodiment.

In the embodiment illustrated here, in particular in FIG. 4, the respective elevation 7 has identical dimensions and/or diameters along a first direction of extension 100 and along a second direction of extension 101. In a non-illustrated exemplary different embodiment, at least one elevation 7 can have different dimensions and/or diameters along a first direction of extension 100 and along a second direction of extension 101. In a further non-illustrated exemplary embodiment, at least one elevation 7 can extend over the entire width of the separating wall 6 along the second direction of extension 101. In a further non-illustrated exemplary embodiment, at least one elevation 7 can be larger in a diameter and can extend up to a curvature of the entire separating wall 6 and can embody a crown bow.

The separating element 5 can have a ledge 8, which is arranged outside of the longitudinal duct 9 in the insertion position of the separating element 5. The ledge 8 can be produced by means of additionally applied material or also for example by means of a forming process.

Figure 6:
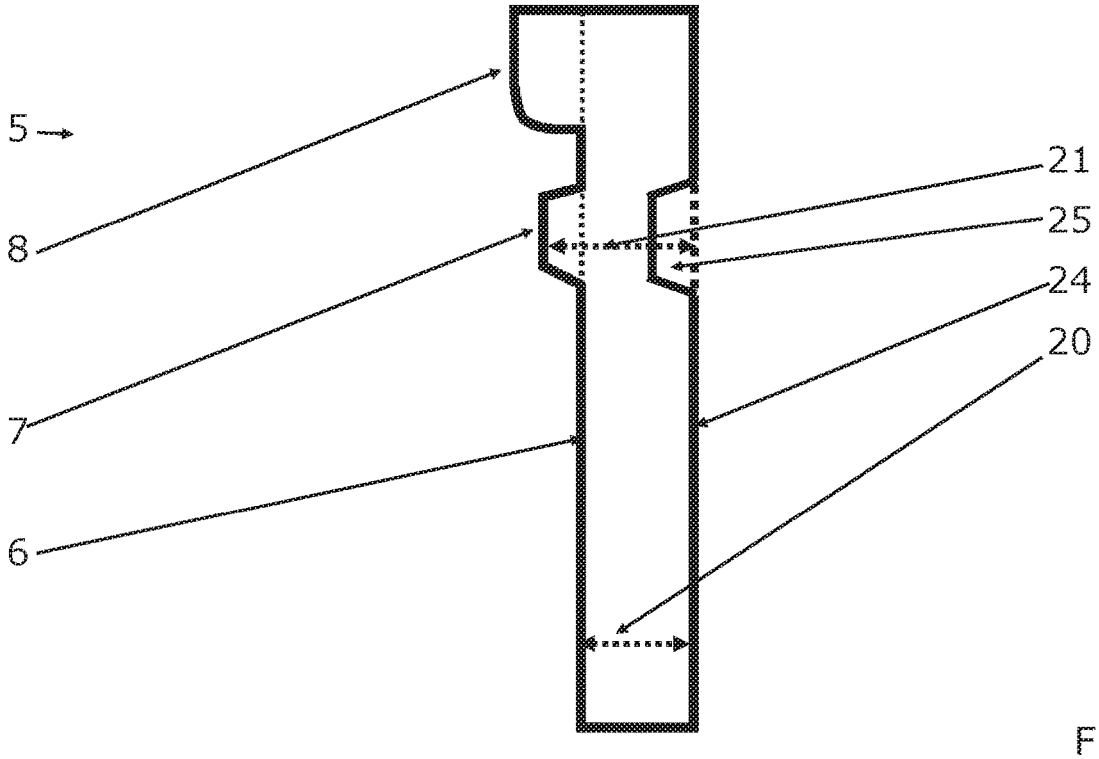
FIG. 6 shows a section through a separating element.

The separating wall thickness 21 and the separating wall thickness 20 can be measured from a common reference point and/or from a common reference line 24. An observation of the separating wall thickness 21 and of the separating wall thickness 20 can thereby take place in the side view, wherein for example recesses and/or bulges 25, which are created, for example, by means of a forming process and/or production process, are not included. This is illustrated in an exemplary manner in FIG. 6, in which a section through a separating element 5 is shown, so that a possible bulge 25 becomes visible. Even though the elevation 7 is embodied here by means of a local forming of the separating wall 6, this effectively leads to an increase of the separating wall thickness 20, so that the elevation 7 is arranged in the area of the recess 4 in the insertion position of the separating element 5, and so that a press fit forms between the elevation 7 and the recess 4.

The invention claimed is:

1. A collector tube for a heat exchanger, which has at least one flat tube between two longitudinal ducts, the two longitudinal ducts each comprising:

a base having a base collar extending therefrom, and a cover that, when together, form one of the longitudinal ducts, wherein the base collar has an inner surface that contacts an outer surface of the cover, and the base collar does not extend into the one longitudinal duct;

a recess in the base, through which a separator is inserted into the longitudinal duct in an insertion position, the recess forming an oblong and planar slot in the base;

wherein the separator has a separating wall comprising a separating wall thickness, wherein a clearance fit is present between the separating wall and the recess in response to the insertion of the separator;

wherein the separating wall provides two elevations spaced apart from one another to attain an increase of the separating wall thickness in a subarea of the separator, the two elevations each engaging an inner surface of the oblong and planar slot;

wherein, in the insertion position of the separator, the two elevations are arranged in an area of the recess; and wherein, in the insertion position, a press fit is present between the two elevations and the recess.

2. The collector tube according to claim 1, wherein the separating wall includes a ledge extending to one side of a surface of the separator and opposite the recess, which, in the insertion position, is arranged outside of the one longitudinal duct of the collector tube.

3. The collector tube according to claim 1, wherein the two elevations have a circular embodiment.

4. The collector tube according to claim 1, wherein the separator is embodied so as to be at least partially complementary to a subarea of an inner wall of the collector tube.

5. The collector tube according to claim 1, wherein:

the cover is arranged so as to be located opposite the base;

the base and the cover embody the one longitudinal duct;

the base has at least one passage having an opening for accommodating the at least one flat tube of the heat exchanger.

6. The collector tube according to claim 1, wherein the two elevations along a first direction of extension and along a second direction of extension have at least one of identical dimensions and identical diameters.

7. The collector tube according to claim 1, wherein a distance between the two elevations is at least twice a diameter of one of the at least two elevations.

8. The collector tube according to claim 7, wherein the two elevations have identical diameters.

9. The collector tube according to claim 2, wherein a first face of the separating wall includes the ledge extending therefrom, and a second face of the separating wall opposite the first face includes a depression that extends toward the ledge.

10. The collector tube according to claim 1, wherein the separator has a ledge on one end and a curved boundary edge that abuts and does not pass through the cover.

11. A heat exchanger for a vehicle, comprising:

a plurality of flat tubes, which are spaced apart from one another; and a longitudinal duct fluidically connecting the flat tubes to one another, the longitudinal duct having a recess, through which a separator is inserted into the longitudinal duct in an insertion position, the recess forming an oblong and planar slot in a base of the longitudinal duct, the longitudinal duct including a base having a base collar extending therefrom, and a cover that, when together, form the longitudinal duct, wherein the base collar has an inner surface that contacts an outer surface of the cover, and the base collar does not extend into the longitudinal duct;

wherein the separator has a separating wall comprising a separating wall thickness, wherein a clearance fit is present between the separating wall and the recess in response to the insertion of the separator;

wherein the separating wall provides two elevations to attain an increase of the separating wall thickness in a subarea of the separator, the two elevations each engaging an inner surface of the oblong and planar slot;

wherein, in the insertion position of the separator, the two elevations are arranged in an area of the recess; and wherein, in the insertion position, a press fit is present between the two elevations and the recess.

12. The heat exchanger according to claim 11, wherein the separator has a ledge extending to one side of a plane of the separator and opposite the recess, which, in the insertion position, is arranged outside of a longitudinal duct of the longitudinal duct.

13. The heat exchanger according to claim 11, wherein the two elevations have a circular embodiment.

14. The heat exchanger according to claim 11, wherein the separator at least partially has a curved boundary edge.

15. The heat exchanger according to claim 11, wherein the separator is embodied so as to be at least partially complementary to a subarea of an inner wall of the longitudinal duct.

16. The heat exchanger according to claim 11, wherein a distance between the two elevations is at least twice a diameter of one of the at least two elevations.

17. The heat exchanger according to claim 16, wherein the two elevations have identical diameters.

18. The heat exchanger according to claim 11, wherein the separator has a ledge on one end and a curved boundary edge that abuts and does not pass through the cover.

19. A collector tube for a heat exchanger, which has at least one flat tube, comprising:

a base having a base collar extending therefrom, and a cover arranged opposite one another and embodying a longitudinal duct, wherein the base collar has an inner surface that contacts an outer surface of the cover, and the base collar does not extend into the longitudinal duct, the base having a generally planar surface; and a recess through the generally planar surface of the base, through which a separator is inserted into the collector tube in an insertion position;

wherein the base has at least one passage comprising an opening for accommodating the at least one flat tube of the heat exchanger;

wherein the separator has a separating wall comprising a separating wall thickness, wherein a clearance fit is present between the separating wall and the recess in response to the insertion of the separator;

wherein the separating wall includes (i) two elevations to attain an increase of the separating wall thickness in a subarea of the separator and (ii) a ledge;

wherein, in the insertion position of the separator, the two elevations are arranged in an area of the recess and the ledge is disposed outside of the longitudinal duct and spaced apart from the base; and wherein, in the insertion position, a press fit is present between the two elevations and the recess.

20. The collector tube according to claim 19, wherein the separator has a curved boundary edge that abuts and does not pass through the cover.

* * * * *